US008419445B1

(12) United States Patent
Yang

(10) Patent No.: US 8,419,445 B1
(45) Date of Patent: Apr. 16, 2013

(54) MEMORY CARD WITH A CONNECTOR

(75) Inventor: Ming-Kung Yang, New Taipei (TW)

(73) Assignee: Main Super Enterprises Co., Ltd., New Taipei (TW)

( * ) Notice: Subject to any disclaimer, the term of this patent is extended or adjusted under 35 U.S.C. 154(b) by 0 days.

(21) Appl. No.: 13/276,384

(22) Filed: Oct. 19, 2011

Related U.S. Application Data

(63) Continuation-in-part of application No. 13/248,133, filed on Sep. 29, 2011.

(30) Foreign Application Priority Data

Sep. 29, 2011 (TW) ..... 100218200 U

(51) Int. Cl.
*H01R 12/00* (2006.01)

(52) U.S. Cl.
USPC ..... 439/76.1; 439/660

(58) Field of Classification Search ..... 439/76.1, 439/83, 630, 660, 946
See application file for complete search history.

(56) References Cited

U.S. PATENT DOCUMENTS 7,438,599 B2 * 10/2008 Uchida et al. ..... 439/630
8,109,772 B2 * 2/2012 Lin ..... 439/76.1
8,202,125 B2 * 6/2012 Li et al. ..... 439/630

* cited by examiner

*Primary Examiner* — Khiem Nguyen
(74) *Attorney, Agent, or Firm* — Rosenberg, Klein & Lee

(57) ABSTRACT

A memory card with a connector includes a card main body for storing data and a connector including multiple terminals and an insulation main body. Multiple terminal soldering sections are disposed on the card main body. The multiple terminals are integrally connected with the insulation main body to form the connector. In manufacturing, the connector integrally composed of the terminals and the insulation main body is directly rested on the card main body. Then, in a one-time soldering process, all the terminals are soldered on the terminal soldering sections of the card main body. Accordingly, the manufacturing process is simplified and the manufacturing cost is lowered. Also, the ratio of good products is increased.

5 Claims, 6 Drawing Sheets

MEMORY CARD WITH A CONNECTOR

CROSS-REFERENCE TO RELATED APPLICATION

This application is a Continuation-in-Part Application of U.S. patent application Ser. No. 13/248,133, entitled "Connector Terminal Structure", filed on 29 Sep. 2011, now pending.

BACKGROUND OF THE INVENTION

1. Field of the Invention

The present invention relates generally to a memory card with a connector, and more particularly to a memory card including a card main body for storing digital data and a connector including multiple terminals and rested on the card main body. In a one-time soldering process, all the terminals are soldered on the card main body to simplify the manufacturing process.

2. Description of the Prior Art

Following the advance of sciences and technologies, the volumes of various electronic products have become smaller and smaller and the weights of the electronic products have become lighter and lighter. Also, the capacity of the memory card used in the electronic product is greatly increased. In addition, the signal transmission speed is greatly increased up to 5.0 Gbps.

Recently, various high-speed memory cards (or flash drives) have been developed. FIG. 6 shows a conventional memory card including a card main body 51 for storing data. Multiple terminals 52*a*, 52*b* are directly soldered on the circuit of the card main body 51. Some terminals 52*a* are in the form of plane faces attached to the card main body 51. The other terminals 52*b* are in the form of elastic arms extending into perforations 511 of the card main body 51. The memory card is connectable to a corresponding electronic device via the terminals 52*a*, 52*b*.

In manufacturing, the terminals 52*a*, 52*b* of the conventional memory card are soldered on the card main body 51 one by one. Recently, the memory card has become smaller and smaller and lighter and lighter. Therefore, the intervals between the adjacent terminals 52*a*, 52*b* are extremely small. As a result, a higher technical level is needed for one by one soldering the terminals 52*a*, 52*b* on the card main body 51. Therefore, the difficulty in manufacturing the memory card is increased. This leads to increase of manufacturing cost. Moreover, the ratio of good products can be hardly increased.

SUMMARY OF THE INVENTION

It is therefore a primary object of the present invention to provide a memory card with a connector. The memory card includes a card main body for storing data and a connector including multiple terminals and an insulation main body. Multiple terminal soldering sections are disposed on a circuit of the card main body. The terminals are fixedly disposed in the insulation main body and integrally connected with the insulation main body. Each terminal has a signal connection end and a soldered end. The signal connection ends are exposed to upper side of the insulation main body. The soldered ends of the terminals extend from the bottom of the insulation main body corresponding to the terminal soldering sections of the card main body. Accordingly, the insulation main body can be rested on the card main body to solder the soldered ends of the terminals on the terminal soldering sections of the card main body. In manufacturing, the connector, which is integrally composed of the terminals and the insulation main body, is directly rested on the card main body. Then, in a one-time soldering process, all the terminals are soldered on the terminal soldering sections of the card main body. Accordingly, the manufacturing process is simplified and the manufacturing cost is lowered. Also, the ratio of good products is increased.

In the above memory card with the connector, the terminals are inserted in the insulation main body or embedded in the insulation main body by means of injection molding. The manner in which the terminals are fixedly disposed in the insulation main body is not limited.

The above memory card with the connector further includes an enclosure formed with a window. The card main body is enclosed in the enclosure with the signal connection ends of the terminals of the connector positioned in the window and exposed to the exterior of the enclosure. The enclosure can house the card main body by means of, but not limited to, injection molding.

In the above memory card with the connector, the insulation main body of the connector has multiple platforms and multiple perforations. The signal connection ends of some of the terminals of the connector are in the form of plane faces respectively correspondingly rested on the platforms of the insulation main body and exposed to the exterior. The signal connection ends of the other of the terminals of the connector are in the form of elastic arms. A free end of each elastic arm is formed with a V-shaped contact section. The elastic arms and the contact sections respectively correspondingly extend into the perforations of the insulation main body in a suspended state.

In the above memory card with the connector, the soldered ends of the terminals of the connector are respectively arranged on two opposite sides of the insulation main body or arranged on the same side of the insulation main body. This is not limited.

In the above memory card with the connector, the terminals are first fixedly disposed in the insulation main body. Then the insulation main body with the terminals is rested on the card main body. Then, in a one-time soldering process, all the terminals fixedly disposed in the insulation main body are soldered on the card main body. Accordingly, it is unnecessary to solder the terminals one by one so that the manufacturing process is simplified and the manufacturing cost is lowered. Also, the ratio of good products is increased.

The present invention can be best understood through the following description and accompanying drawings, wherein:

DETAILED DESCRIPTION OF THE PREFERRED EMBODIMENTS

Figure 1:
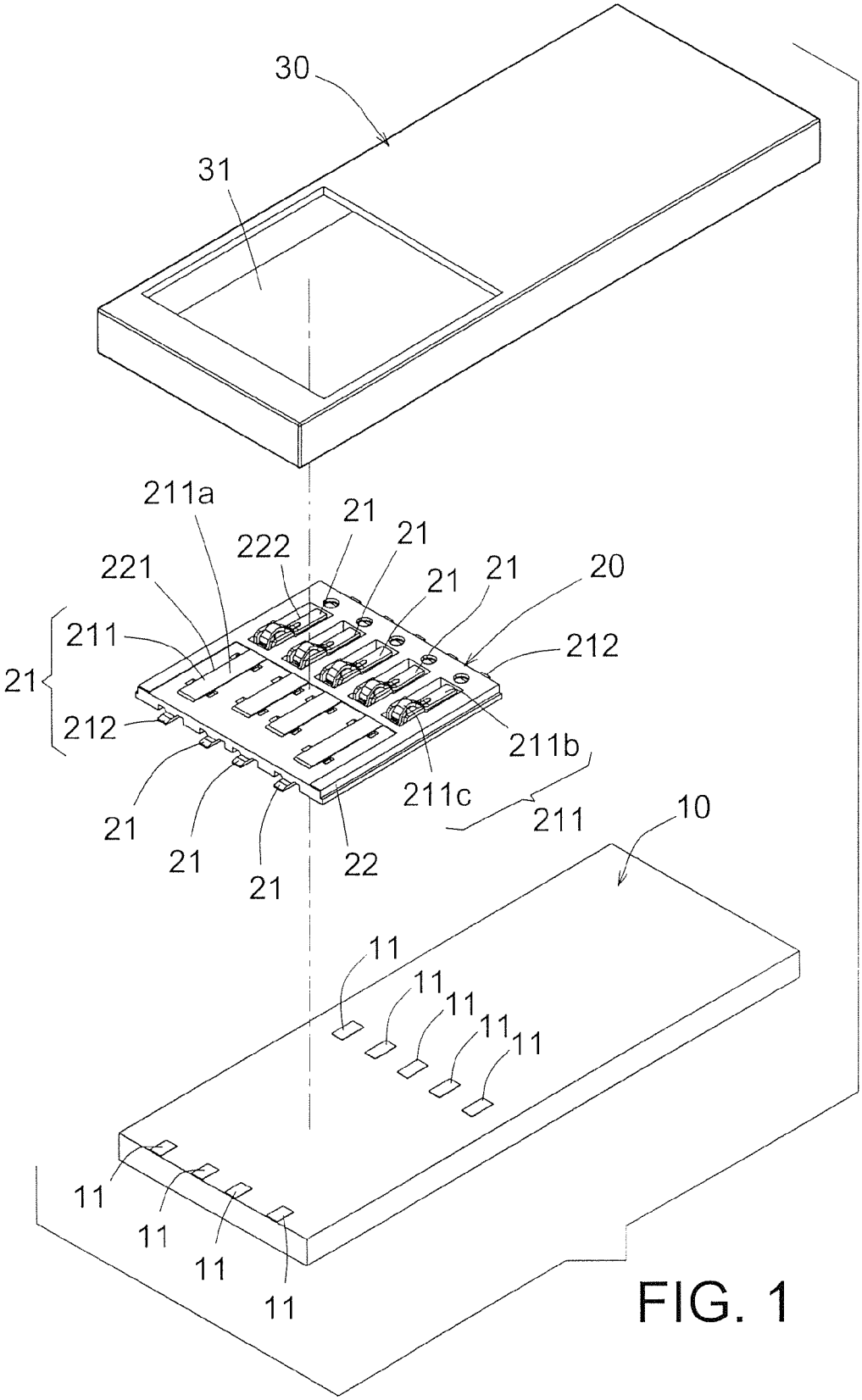
FIG. 1 is a perspective exploded view of a first embodiment of the present invention.
Figure 2:
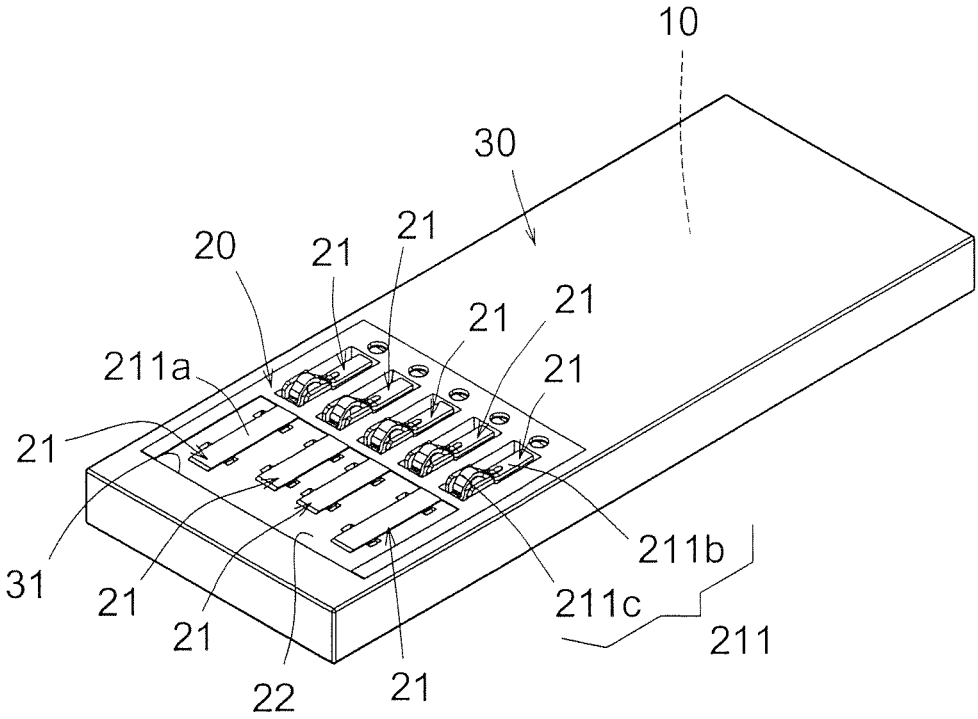
FIG. 2 is a perspective assembled view of the first embodiment of the present invention.
Figure 3:
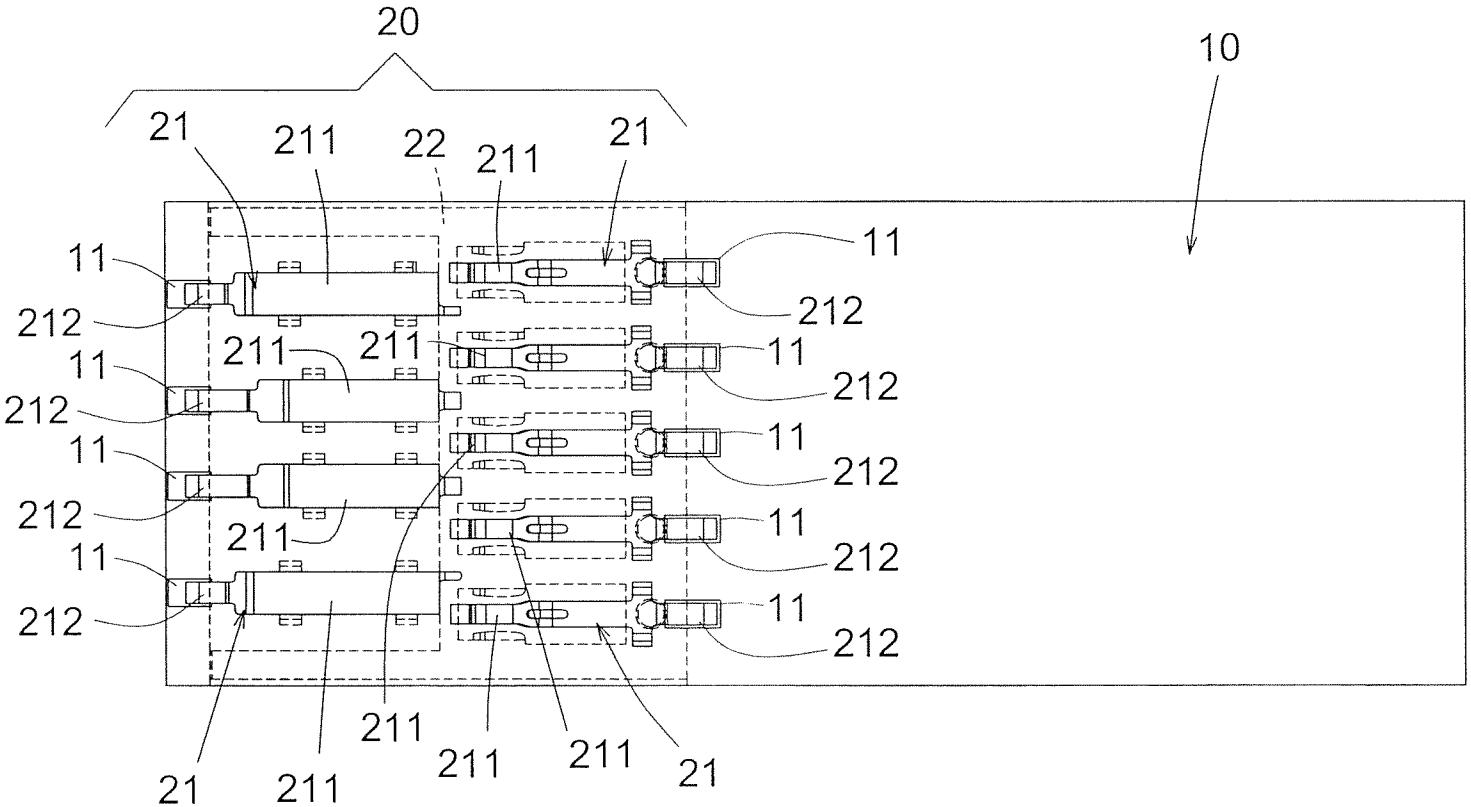
FIG. 3 is a top view according to FIG. 1, showing that the connector is soldered on the card main body of the present invention.
Figure 4:
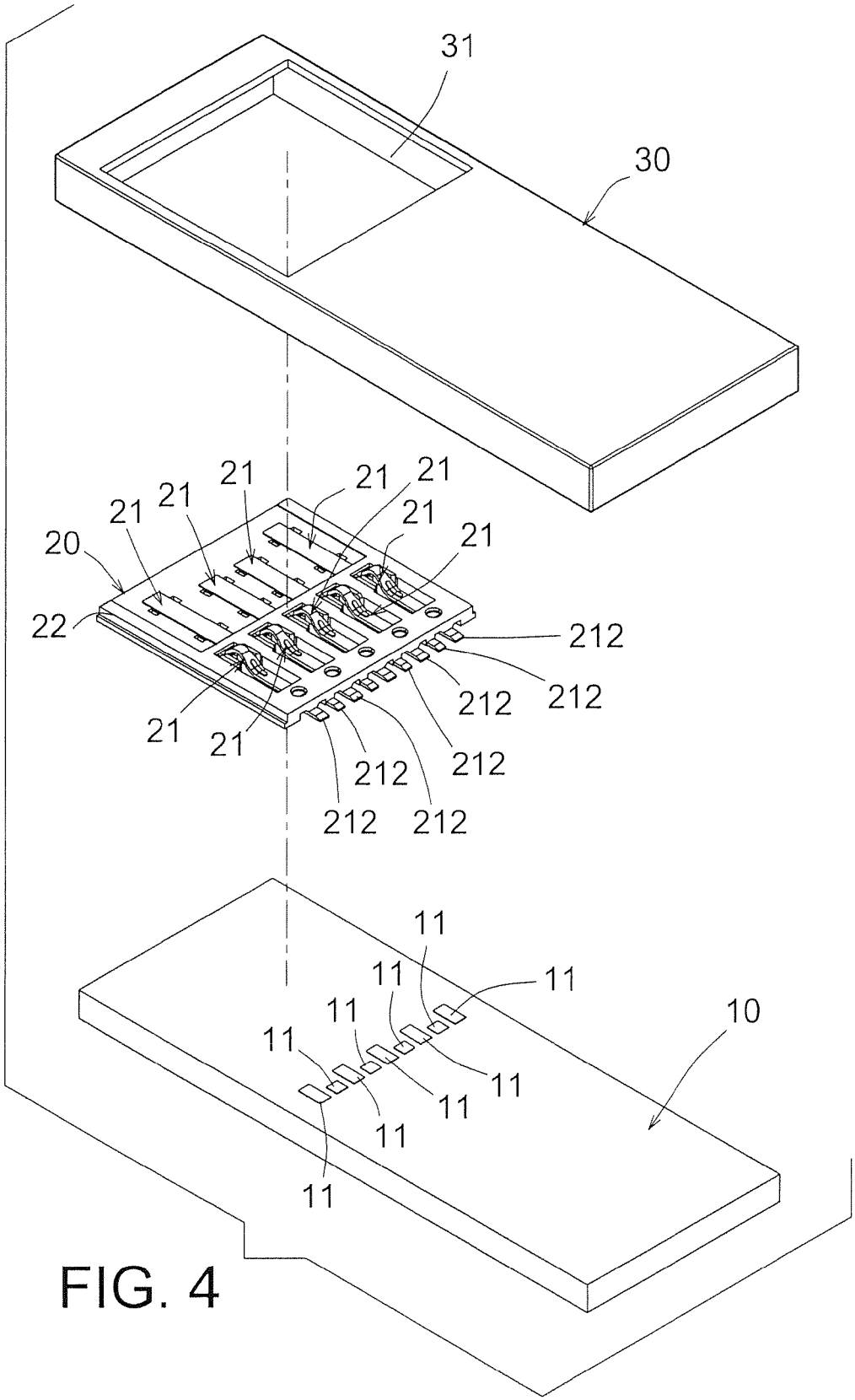
FIG. 4 is a perspective exploded view of a second embodiment of the present invention.
Figure 5:
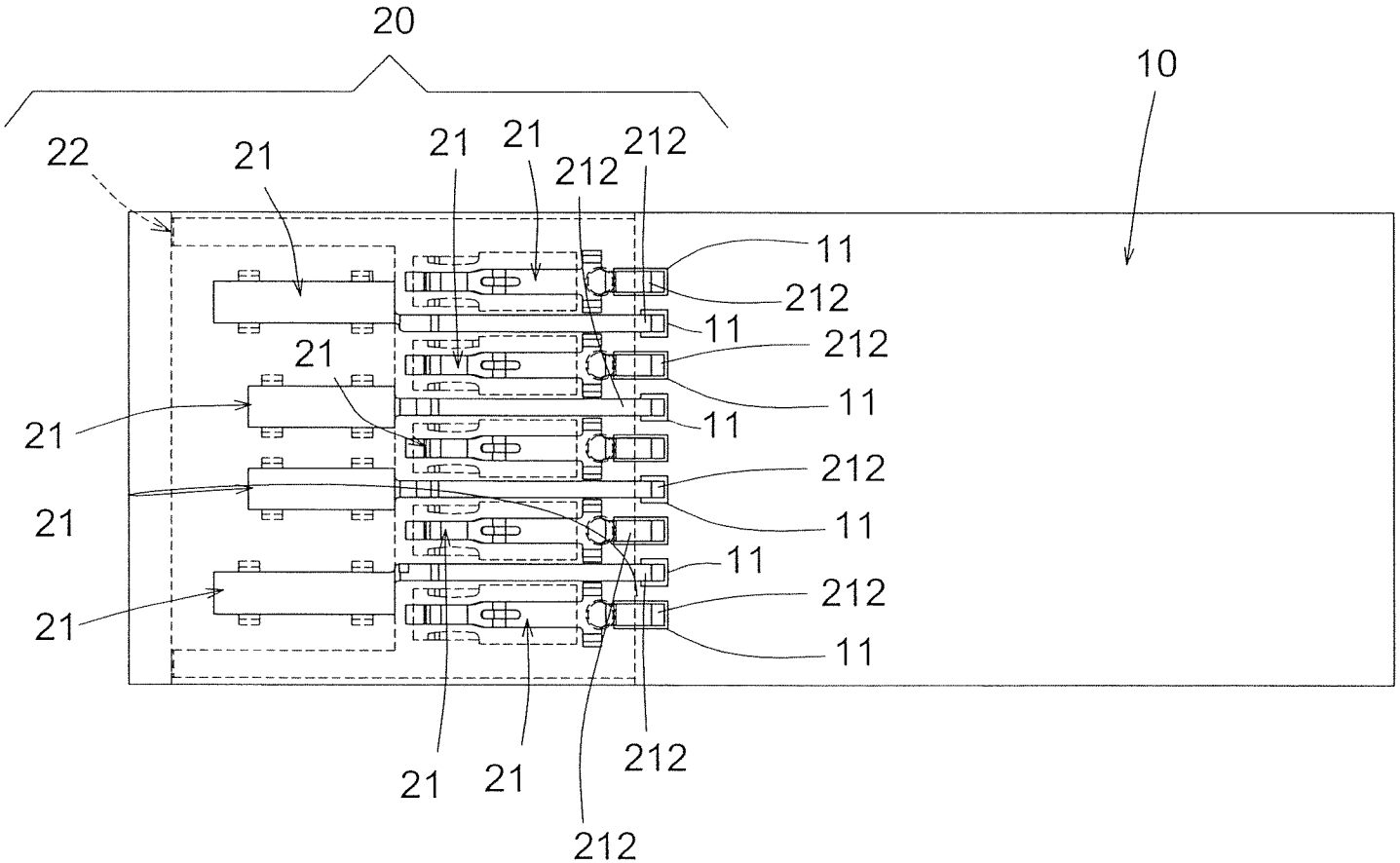
FIG. 5 is a top view according to FIG. 4, showing that the connector is soldered on the card main body of the present invention.
Figure 6:
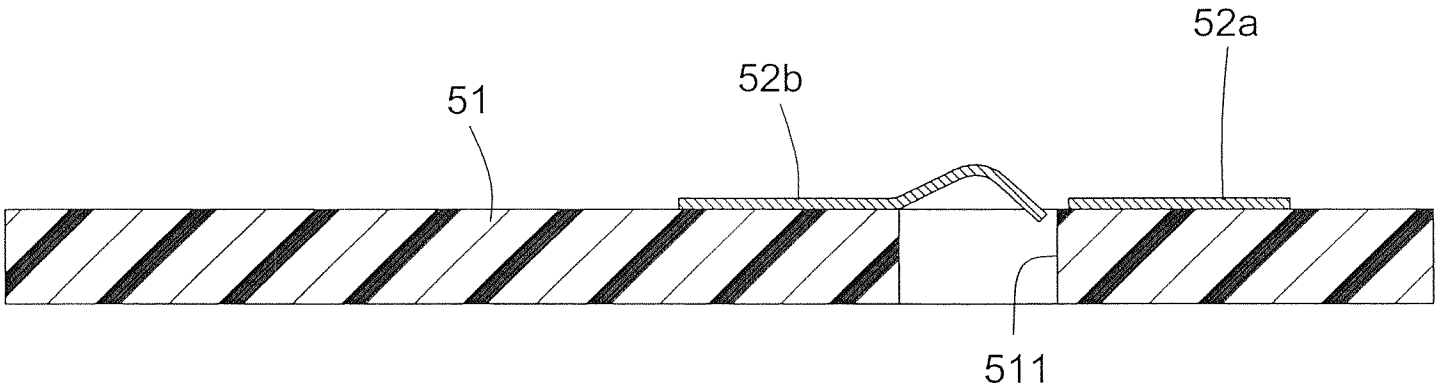
FIG. 6 PRIOR ART
FIG. 6 is a sectional view of a conventional memory card.

Please refer to FIGS. 1, 2, 3 and 4. The memory card with the connector of the present invention includes a card main body 10 for storing data and a connector 20 including multiple terminals 21 and an insulation main body 22. Multiple terminal soldering sections 11 are disposed on a circuit of the card main body 10. The terminals 21 are fixedly disposed in the insulation main body 22 and integrally connected with the insulation main body 22. Each terminal 21 has a signal connection end 211 and a soldered end 212. The signal connection ends 211 are exposed to upper side of the insulation main body 22. The soldered ends 212 of the terminals 21 extend from the bottom of the insulation main body 22 corresponding to the terminal soldering sections 11 of the card main body 10. Accordingly, the insulation main body 22 can be rested on the card main body 10 to solder the soldered ends 212 of the terminals 21 on the terminal soldering sections 11 of the card main body 10. In manufacturing, the connector 20, which is integrally composed of the terminals 21 and the insulation main body 22, is directly rested on the card main body 10. Then, in a one-time soldering process, (for example, by means of passing the connector 20 and the card main body 10 through a high-temperature area), all the terminals 21 are soldered on the terminal soldering sections 11 of the card main body 10. Accordingly, the manufacturing process is simplified and the manufacturing cost is lowered. Also, the ratio of good products is increased.

The memory card with the connector of the present invention further includes an enclosure 30 formed with a window 31. The card main body 10 is enclosed in the enclosure 30 with the signal connection ends 211 of the terminals 21 of the connector 20 positioned in the window 31 and exposed to the exterior of the enclosure 30. The enclosure 30 can house the card main body 10 by means of, but not limited to, injection molding.

In the memory card with the connector of the present invention, the insulation main body 22 of the connector 10 has multiple platforms 221 and multiple perforations 222. The signal connection ends 211 of some (generally four) of the terminals 21 of the connector 20 are in the form of plane faces 211*a* respectively correspondingly rested on the platforms 221 of the insulation main body 22 and exposed to the exterior. The signal connection ends 211 of the other (generally five) of the terminals 21 of the connector 20 are in the form of elastic arms 211*b*. A free end of each elastic arm 211*b* is bent to form a V-shaped or raised contact section 211*c*. The elastic arms 211*b* and the contact sections 211*c* respectively correspondingly extend into the perforations 222 of the insulation main body 22 in a suspended state.

In the memory card with the connector of the present invention, the soldered ends 212 of the terminals 21 of the connector 20 are respectively arranged on two opposite sides of the insulation main body 22. Alternatively, the soldered ends 212 of the terminals 21 of the connector 20 can be arranged on the same side of the insulation main body 22. This is not limited.

In the memory card with the connector of the present invention, the terminals 21 are first fixedly disposed in the insulation main body 22 and integrally connected with the insulation main body 22. Then the insulation main body 22 with the terminals 21 is directly rested on the card main body 10. This process can be mechanically automatically completed. Then, in a one-time soldering process, all the terminals 21 fixedly disposed in the insulation main body 22 are soldered on the terminal soldering sections 11 of the card main body 10. Accordingly, it is unnecessary to solder the terminals one by one so that the manufacturing process is simplified and the manufacturing cost is lowered. Also, the ratio of good products is increased.

The above embodiments are only used to illustrate the present invention, not intended to limit the scope thereof. Many modifications of the above embodiments can be made without departing from the spirit of the present invention.

What is claimed is:

1. A memory card with a connector, comprising:

(a) a card main body for storing data, multiple terminal soldering sections being disposed on the card main body; and (b) a connector including multiple terminals and an insulation main body, the terminals being fixedly disposed in the insulation main body and integrally connected with the insulation main body, each terminal having a signal connection end and a soldered end, the signal connection ends being exposed to upper side of the insulation main body, the soldered ends of the terminals extending from a bottom of the insulation main body corresponding to the terminal soldering sections of the card main body, whereby the insulation main body can be rested on the card main body to solder the soldered ends of the terminals on the terminal soldering sections of the card main body;

wherein the insulation main body of the connector has multiple platforms and multiple perforations, the signal connection ends of some of the terminals of the connector being in the form of plane faces respectively correspondingly rested on the platforms of the insulation main body and exposed to the exterior, the signal connection ends of the other of the terminals of the connector being in the form of elastic arms, a free end of each elastic arm being formed with a contact section, the elastic arms and the contact sections respectively correspondingly extending into the perforations of the insulation main body in a suspended state.

2. The memory card with the connector as claimed in claim 1, further comprising an enclosure formed with a window, the card main body being enclosed in the enclosure with the signal connection ends of the terminals of the connector positioned in the window and exposed to an exterior of the enclosure.

3. The memory card with the connector as claimed in claim 2, wherein the enclosure houses the card main body by means of injection molding.

4. The memory card with the connector as claimed in claim 1, wherein the soldered ends of the terminals of the connector are respectively arranged on two opposite sides of the insulation main body.

5. The memory card with the connector as claimed in claim 1, wherein the soldered ends of the terminals of the connector are arranged on the same side of the insulation main body.

* * * * *